United States Patent [19]

Shimizu et al.

[11] Patent Number: 4,569,656

[45] Date of Patent: Feb. 11, 1986

[54] WICK FOR LIQUID FUEL BURNERS

[75] Inventors: Hideharu Shimizu, Yamatokoriyama; Noboru Katsuragi, Nara; Kazuhiro Nakano, Nabari, all of Japan

[73] Assignee: Matsushita Electric Industrial Co., Ltd., Kadoma, Japan

[21] Appl. No.: 708,380

[22] PCT Filed: Jun. 10, 1981

[86] PCT No.: PCT/JP81/00136

§ 371 Date: Jan. 22, 1982

§ 102(e) Date: Jan. 22, 1982

[87] PCT Pub. No.: WO81/03692

PCT Pub. Date: Dec. 24, 1981

Related U.S. Application Data

[63] Continuation of Ser. No. 346,062, Jan. 22, 1982, abandoned.

[30] Foreign Application Priority Data

Jun. 11, 1980 [JP] Japan ..... 55-82396

[51] Int. Cl.[4] ..... F23D 3/18

[52] U.S. Cl. ..... 431/325; 431/298

[58] Field of Search ..... 431/325, 323, 288, 298; 252/425.5, 428

[56] References Cited

U.S. PATENT DOCUMENTS

| | | | |
|---|---|---|---|
| 185,679 | 12/1876 | Hopkins | 431/325 |
| 555,257 | 2/1896 | Morss | 431/325 |
| 609,485 | 8/1898 | Wilcox | 431/195 |
| 911,622 | 2/1909 | Smith | 431/325 |
| 1,570,666 | 1/1926 | Geppert | 431/325 |
| 1,981,107 | 11/1934 | Jefferson | 431/298 X |
| 2,013,442 | 9/1935 | Hughes | 431/325 |
| 3,652,197 | 3/1972 | Tokarz | 252/425.5 |
| 3,898,039 | 8/1975 | Lin | 252/425.5 |
| 4,073,999 | 2/1978 | Bryan et al. | 252/461 |

FOREIGN PATENT DOCUMENTS

| | | | |
|---|---|---|---|
| 710047 | 9/1941 | Fed. Rep. of Germany | 431/325 |
| 1085114 | 7/1960 | Fed. Rep. of Germany | 431/325 |
| 40-17502 | 6/1965 | Japan . | |
| 49-140732 | 12/1974 | Japan . | |
| 51-92737 | 7/1976 | Japan . | |
| 5229 | 1/1979 | Japan | 431/298 |
| 54-33623 | 10/1979 | Japan . | |
| 149945 | 11/1979 | Japan . | |
| 54-149945 | 11/1979 | Japan . | |
| 55-27065 | 2/1980 | Japan . | |
| 33502 | 3/1980 | Japan | 431/325 |
| 65809 | 5/1980 | Japan | 431/326 |
| 845639 | 8/1960 | United Kingdom | 431/325 |

*Primary Examiner*—Samuel Scott
*Assistant Examiner*—Carl D. Price
*Attorney, Agent, or Firm*—Cushman, Darby & Cushman

[57] ABSTRACT

This invention relates to a wick for liquid fuel burner wherein liquid fuel is drawn and burnt. A thin sheet body made with fine ceramic fibers bound by an organic binder is installed on the combustion part at the top of the wick, to thereby improve the durability of the wick while using inferior quality liquid fuel.

4 Claims, 12 Drawing Figures

WICK FOR LIQUID FUEL BURNERS

This is a continuation of application Ser. No. 346,062 filed Jan. 22, 1982 which was abandoned upon the filing hereof.

FIELD OF THE TECHNOLOGY

The present invention relates to a wick for liquid fuel; burners for the combustion of liquid fuels, such as kerosene, and more particularly it relates to a wick for liquid fuel burners which has high durability to liquid fuels of inferior quality and also has superior strength.

BACKGROUND OF TECHNOLOGY

Conventionally, a liquid fuel burner wick of this type, as shown in FIG. 12, is adapted for use by being vertically movably fitted between inner and outer guide sleeves B and C protruding from the fuel tank A of the burner, said wick being held in a raised position as shown during burning, with the upper exposed portion thereof allowing the liquid fuel to evaporate for combustion. This wick D generally comprises a combustion part, consisting of woven fabrics E and F mainly of glass fiber, and a draw-up part consisting of a woven fabric G mainly of cotton and staple fiber, said parts being sewn together end-to-end.

The most serious problem with this wick D is that a tarry material is formed on the wick, to make manipulation of the wick for vertical movement impossible and/or producing deterioration of combustion (failure to burn). Most frequent cause thereof is that the kerosene which is used as the liquid fuel has been oxidized and rendered liable to form tar. Other causes include contamination of kerosene with foreign oils, such as salad oil or light (Diesel) oil, and dispersions of the boiling point of kerosene itself.

In this connection, JIS (Japanese Industrial Standards) kerosene No. 1, called good-quality kerosene, has been used today as a liquid fuel for kerosene stoves and the like, and the 95% distillation temperature of said kerosene as determined by distillation test is nominally below 270° C. and actually about 240° C. in most cases; it is sometimes as low as 220° C. and sometimes as high as about 260° C., a difference of about 40° C. Further, the manner of formation of tarry material correlates with the boiling point (for which 95% distillation temperature is substituted) of the fuel, and it has been found that a kerosene which has a distillation temperature of 260° C., even if not deteriorated, tends to result in an undesirable formation of tarry material. On the other hand, the worsening of the present condition of oil supply is threatening a danger of impeding the supply of said kerosene No. 1 to such extent that such a proposal has been advanced as to alter the JIS to change the 270° C. to the 280° C. as a countermeasure, so as to allow extraction of a greater proportion of kerosene with the intention of filling the gap between supply and demand, thus, the present situation is such that one cannot but admit that a trend toward change from lighter to heavier fuels is proceeding step by step.

When the wick D in FIG. 12 with the combustion part made mainly of glass fiber is used with the kerosene of inferior quality described above, the combustion part can hold only such a small amount of oil as to become unusable in a relatively short time.

A careful study of the process of formation of tarry material has shown that a wick which can withstand the use of kerosene of inferior quality is one whose combustion part holds a relatively large amount of oil and is at low temperature, in which case even when tarry material is formed, it is relatively soft and small in amount so that the tar is allowed to dissolve in the abundant kerosene, and is diffused toward the bottom of the wick D.

Therefore, it is enough to increase the oil content of the combustion part of such a wick D, and an approach can be adopted in the case of the conventional wick D mainly of glass fiber, such as to minimize the distance from the kerosene level to the combustion part, i.e., the draw-up height of the wick D, whereby some effect can be attained; but, this method can be actually employed only for new products, and can not be embodied for burners which have been sold in the past; further, decreasing the distance from the oil level to the combustion part increases the degree of fire danger by a corresponding amount, so that at present said method cannot be embodied so readily.

DISCLOSURE OF THE INVENTION

Accordingly, the present invention provides wicks of strong durability, even when the draw-up height of the wick is retained unchanged to the conventional one.

Hereinafter, embodiments of the present invention are elucidated together with the attached drawings.

THE BEST MODE FOR CARRYING OUT THE INVENTION

Figure 1:
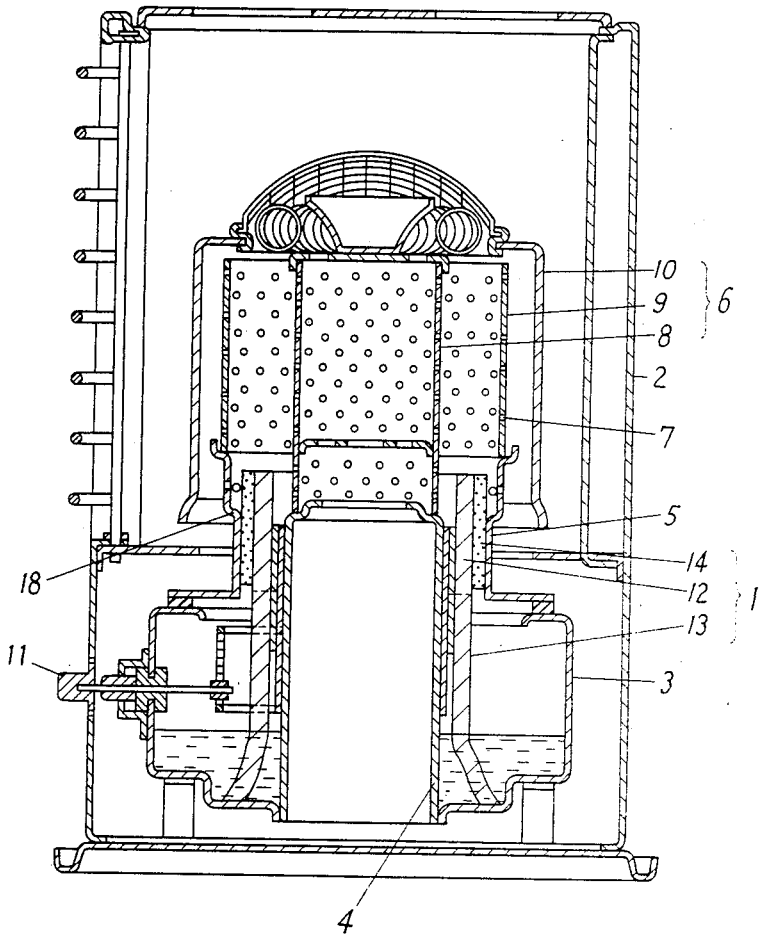
FIG. 1 is a sectional view of a burner using an example of a liquid fuel burner wick in accordance with the present invention.
Figure 2:
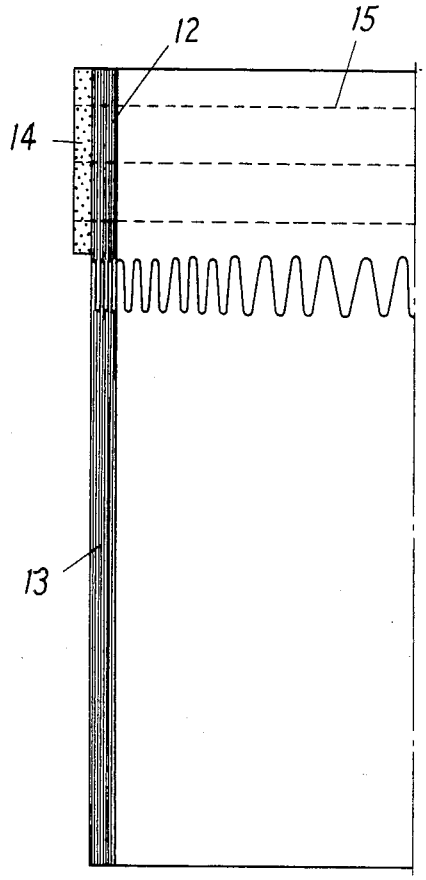
FIG. 2 is a sectional half view of the wick.

In FIG. 1, a burner using a liquid fuel burner wick 1 is provided with a fuel tank 3 in a main body 2 with the upper front surface open, and inner and outer guide sleeves 4 and 5 for vertically movably holding the wick 1 therebetween are provided to stand upwardly on said fuel tank 3. On the inner and outer guide sleeves 4 and 5 holding said wick 1 is removably fitted a combustion cylinder 6 for burning the liquid fuel drawn up by the wick 1. The combustion cylinder 6 comprises inner and outer flame sleeves 8 and 9 provided with a large number of vent holes 7 for burning the fuel vaporized from the wick 1, and an outer sleeve 10 surrounding the flame sleeves. The front lower portion of the main body 2 is provided with an operating knob 11, which is constituted to be capable of vertically moving the wick 1 by operation thereof.

On the other hand, the wick 1 comprises a combustion part base fabric 12 made of mixed spun yarn (12*a* in FIG. 4) consisting mainly of glass fiber mixed with staple fiber or carbon fiber, and a draw-up part 13 made of yarn (13*a* in FIG. 4) consisting of cotton and/or staple fiber, both of these parts being integrally knitted on a Raschel loom. A thin sheet body 14 made of fine ceramic fiber manufactured into a paper form and then shaped by using of an organic binder, such as polyvinyl acetate or a polyacrylic ester, is fastened to said combustion part base fabric 12 by several straight stitch sewing threads 15.

Figure 3:
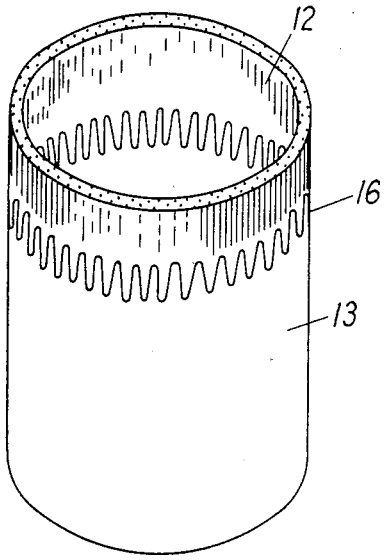
FIG. 3 is a perspective view of the same wick.
Figure 4:
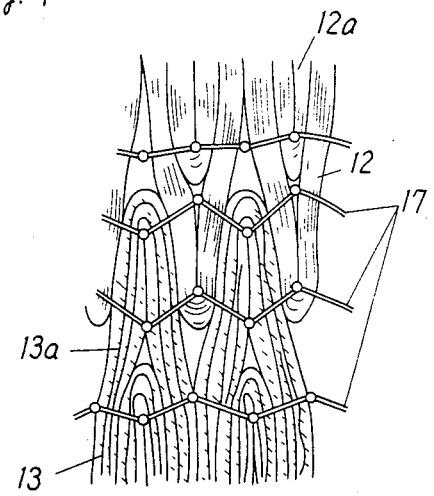
FIG. 4 is an enlarged front view of the principal portion of the same wick.

FIG. 3 shows the wick 1 comprising said combustion part base fabric 12 and draw-up part 13, which are integrally knitted into a cylindrical form by a Raschel loom, and FIG. 4 is an enlarged view of the joined portion 16 of the wick. As shown in FIG. 4, the heat-resistant yarn 12*a* mainly consisting of glass fiber constituting the combustion part base fabric 12 and the draw-up part 13 mainly consisting of cotton and staple fiber are combined with each other so as not to overlap each other over a required width in opposed U-forms and are joined together by chain-stitches using weft threads 17.

The thin sheet body 14 of ceramic fiber has a small bulk density, voids of as high as 80–90% with many tiny pores, and an oil content thereof is as high as 0.6–0.7 g/cm$^3$, which is almost incomparable with the oil content of ones consisting mainly of glass fiber.

Since the thin sheet body 14 is made of ceramic fiber, it is highly heat resistant, and one composed of $SiO_2$ and $Al_2O_3$ about fifty-fifty can be used at temperatures up to about 1300° C. The high oil content of the thin sheet body 14 is accounted for by the fact that, since the ceramic fiber is as thin as 2–3$\mu$, the voids are large and the pores are very small and are all filled with kerosene by capillary action.

The thickness of conventional glass fibers is 7–9$\mu$, and when they are woven into fabrics, the resulting capillary tubes are large in size. Thus, even if these fabrics have many pores, the capillary tubes are too large to produce a sufficient capillary action for the kerosene to fill the pores, resulting in a small oil content. If these glass fibers are reduced in thickness to 2–3$\mu$, as in the ceramic fiber of the present embodiment, they would readily melt and become unusable, since their heat resistance is so low.

In the arrangement described above, since the thin sheet body 14 of ceramic fiber is used in the combustion part of the wick 1, the oil content of this part becomes high. As a result, the temperature of the combustion part during operation is low, so that tar is not likely to form, and even if the tar forms it is soft, so that it can diffuse into the abundant kerosene, and thus, various adverse effects of tar are no longer produced. Further, its manufacturing process is only attachment by sewing of the thin sheet body 14 consisting of ceramic fiber, so that it is provided at a low cost.

Figure 10:
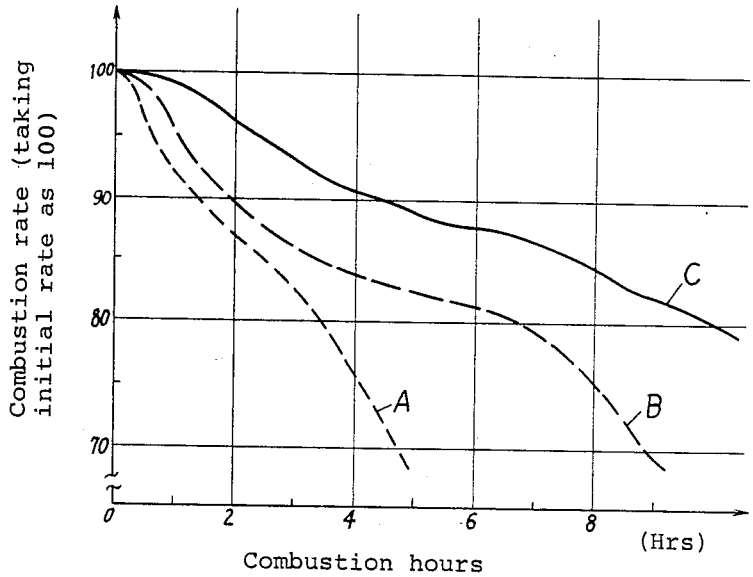
FIG. 10 is a characteristic graph showing of comparable states deterioration of the combustion rate of wicks embodying this invention and conventional wicks.

FIG. 10 shows the results of combustion tests using kerosene contaminated with salad oil as an example of kerosene of inferior quality. In the graph, the line A refers to a combustion part consisting of conventional glass fiber wherein the distance from the oil level to the flame dish 18 is 125 mm, the line B refers to said combustion part consisting of said glass fiber but said distance is 80 mm, and the line C refers to the article of the present embodiment wherein said distance is 125 mm. As is apparent from the line C, the article of the present embodiment is strongly resistant to the kerosene of inferior quality (i.e., the combustion rate will not decrease greatly).

The factors which contribute to the attainment of this effect in accordance with the present invention may be mentioned such that the fiber diameter is reduced to less than half the conventional glass fiber diameter, and the constitution of manufacturing the same into a paper form; and by doing so, it appears that the capillary tubes given by this arrangement are very fine and uniform thereby having no interruption or break of the capillary tubes, so that a substantially constant oil content can be attained if the draw-up height is within the range of the capillary phenomenon action. The amount of oil held in the tip portion of the combustion part is large, therefore, the temperature in said portion is not likely to rise high, and hence the amount of tar formed becomes small, and it also appears that even if tar forms, the tar forms on the surface of the combustion part since the capillary tubes are very fine and almost filled with kerosene, resulting in that the tar is almost burnt off clean by burning-off (burning continued without a supply of liquid fuel to the wick).

Figure 11:
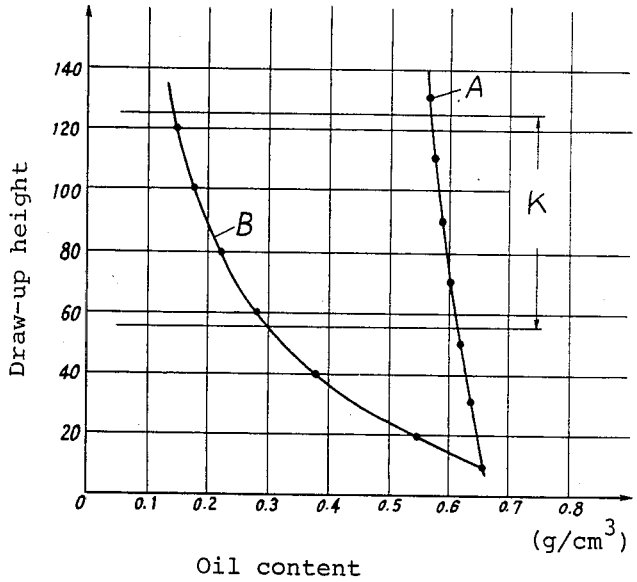
FIG. 11 is a characteristic graph showing the relationship between kerosene draw-up height and oil content.
Figure 12:
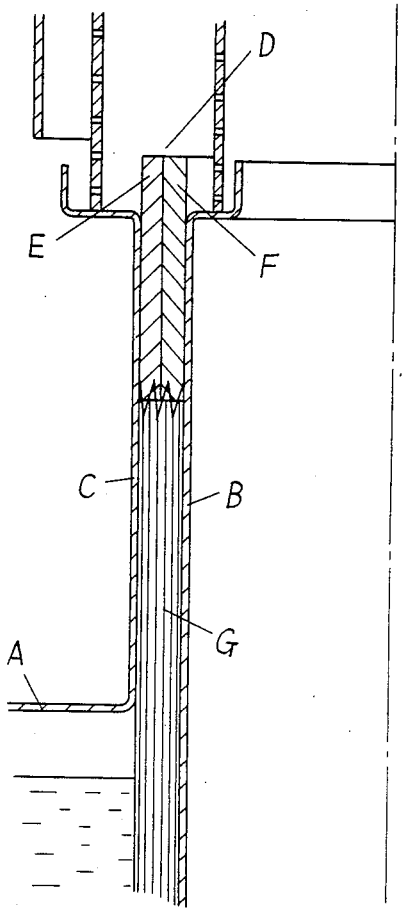
Fig. 12 (PRIOR ART)
FIG. 12 is a sectional view of a conventional wick for liquid fuel burners.

FIG. 11 shows the relationship between said oil content and draw-up height; A is the article of the present embodiment and B is using a conventional wick made of glass fiber; it can be seen that in the article A the oil content does not vary so much with the change of the draw-up height, and maintains a relatively large oil content even at a great draw-up height. By the way, K refers to the draw-up height range for presently manufactured kerosene stoves. It has been ascertained that such characteristic varies very little in the case of the fiber diameter being 4$\mu$ or less and approaches the curve for the combustion part made of glass fiber shown by the line B in FIG. 11 as the fiber diameter becomes larger than 4$\mu$. That is to say, capillary phenomenon action, which affects the oil content to a great extent, is defined by a balance of surface tension $\delta$ and gravity, and the equation of $2\pi r\delta = 90\ r^2 hdg$ holds. There, r is the capillary tube radius, h is the draw-up height d is the density of the liquid, and g is the acceleration of gravity. Therefore, $h = 2\delta/rdg$, and the draw-up height is inversely proportional to the size of the capillary tube. In other words, it is inversely proportional also to the thickness of the fiber. If the fiber diameter is 4$\mu$ or less, probably it is considered that there would be produced no influence provided that the draw-up height range in current use for burners is maintained, but if it becomes thicker than said figure h decreases and some influence would be produced.

However, what must be considered here is that no matter how thin the fiber may be, if the density (bulk density) of the wick is made too small, then the capillary tubes could be thick and hence the oil content could be small contrary to expectation. For example, a combustion part with a bulk density of 0.25 g/cm$^3$ or less which is made of ceramic fiber (2.6–3$\mu$) having a true density of 2.6 g/cm$^3$ shows a tendency to approach the curve B for glass fiber in FIG. 11. This, in other words, suggests that the voids of the combustion part must not be above about 90%.

Hereupon, another consideration to be made is the heat resistance of the fiber, since when the diameter of the fiber is made smaller its temperature tends to rise higher.

For example, even if a conventional combustion part using 9$\mu$ glass fiber is subjected to burning-off ten times or so, this results only in its tip edge part being rounded, whereas a combustion part using 3$\mu$ glass fiber, when subjected to burning-off only once, becomes molten and unusable. The temperature at the burning-off becomes about 800° C. Therefore, materials having heat resistance of above 800° C. are preferable, and ceramic fiber, which becomes now commercially sold in large quantities, is most suitable, it having a heat resistance of above 1000° C., and melting of the wick tip edge part was not seen even after a number of burning-off cleanings.

In addition, rock wool is said to have a heat resistance of about 600° C., but it has been found that its fiber of 2–4μ in thickness is usable for it only slightly melted after 10 times of dry burnings.

Another feature of the wick 1 constructed in the manner described above is the use of a soft organic binder, such as polyvinyl acetate resin.

That is, since inorganic binders are lacking in softness, they can not be worked into cylindrical shaping, and even if they should allow such shaping, sewing for attachment to the combustion part base fabric 12 would be difficult. On the other hand, the organic binders are sufficiently soft to allow easy cylindrical shaping, and easy and reliable sewing for attachment to the combustion part base fabric 12.

Although dry burning of the combustion part results in some burning of the organic binder, this does not affect the mechanical strength so much. Though the reason can not be fully ascertained at the present, it is believed that this is because in the combustion part where kerosene is once drawn up, the organic binder and kerosene are slightly retained in the form of high molecular compounds at the time of dry burning, serving as a binder. It also appears that the dry burning temperature itself is not so high as to effect complete combustion of the organic binder.

As for the amount of organic binder, taking the case of polyvinyl acetate resin, for example, when the weight of the amount added is less than 3% of the weight of the thin sheet body, the mechanical strength of the wick 1 is reduced to the extent that the wick is no longer fit for use, whereas when it is greater than 15% , an increased amount of tar is liable to form because of the tendency of polyvinyl acetate resin to form tar state substances, thereby deteriorating the draw-up performance of the wick 1. In addition, it has been found that the use of organic binders other than polyvinyl acetate resin makes no great difference in result when the binder content is changed as described above.

If sulfur, nitrogen and/or chlorine is contained among the elements of the organic binder, their combustion products are liable to corrode metals and also emit a bad odor, and therefore, organic binders which are composed of hydrogen, carbon and oxygen and whose combustion products are water and carbon dioxide are ideal.

The thin sheet body 14 made of heat resistant fiber manufactured into a paper form which is then shaped by the use of an organic binder, as described above, is sufficiently abundant of flexibility, and therefore can be bent arcuately with ease and further is capable of being sewn on the sewing machine, so that it can be produced in substantially the same process as in those made of conventional glass fiber. However, since it is impossible to be folded to 180°, by dividing it in circumferential direction of the combustion part into plural number parts, it can be easily folded flat, so that it is not bulky for transport. However, dividing it into too many parts entails much labor in production, while dividing it into a small odd number of parts makes the folding flat impossible. Thus, the prefereable number of divisions is 4 or so.

In the wick 1 of the present embodiment having increased durability to liquid fuels of inferior quality, there is a problem which arises from the increased durability. That is, whereas a conventional wick will soon become unable to continue combustion by kerosene of inferior quality, the wick 1 of the present embodiment, is capable of continuing combustion for a long period of time even if used with kerosene of inferior quality, therefore tar will be formed, though slowly, on the combustion part and since said tar contracts owing to heat, the diameter of the combustion part is reduced, making it impossible to raise and lower the wick. If this problem is solved, the performance of the wick is further improved. According to the invention, this problem is solved as follows: The combustion part of the wick 1 is impregnated with an inorganic binder, for example, colloidal silica and alumina sol, and shaped into cylindrical shape, and this approach reduces shrinkage almost to zero. An example of this treatment will now be described. Colloidal silica (20% solution of "Snowtex C" produced by Nissan Chemical Industries, Ltd.) was used as an inorganic binder, to which water and ethyl alcohol in equal amounts were added, the resulting matter (with the colloidal silica being 6.7% ) being applied to the combustion part of the wick 1 for impregnation and said combustion part, and before drying, was clamped by a jig for controlling the inner and outer diameters and thereby cylindrically shaped.

Figure 5:
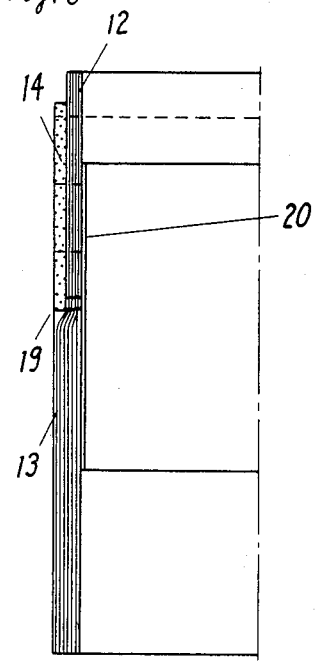
FIGS. 5 through 9 are sectional half views, illustrating other embodiments of liquid fuel burner wicks in accordance with the present invention.
Figure 6:
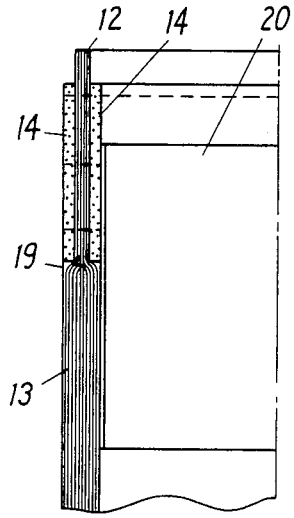
Figure 7:
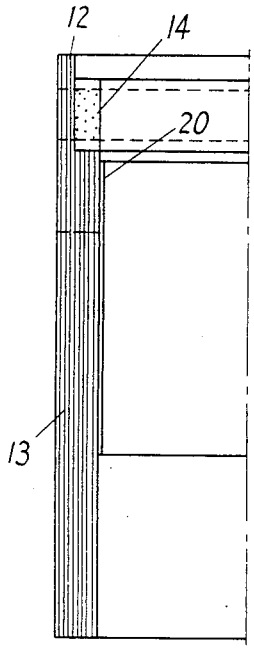
Figure 8:
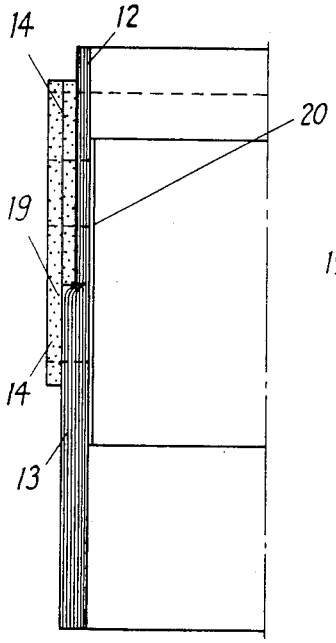
Figure 9:
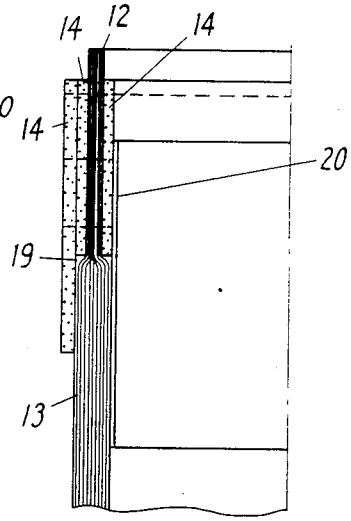

FIGS. 5 through 9 show other embodiments of the invention, wherein the combustion part base fabric 12 is knitted to be thinner than the draw-up part 13 and to that part a thin sheet body or bodies 14 of ceramic fiber is sewn; FIG. 5 to FIG. 7 show examples where the thicknesses of the combustion part and the draw-up part 13 are made the same. However, since the oil content in the combustion part is the most influential factor in case kerosene of inferior quality is used, it is preferable to use as many as possible of thin sheet bodies 14 made of ceramic fiber, although the combustion part becomes thicker, as shown in FIGS. 8 and 9.

In the case of FIGS. 8 and 9, in order to prevent a step 19 between the combustion part base fabric 12 and the draw-up part 13 from being caught by the inner and outer quide sleeves 4 and 5 when the wick 1 is vertically moved, the outside thin sheet body 14 is extended covering said step 19 to the draw-up part 13, while a stiff thin metal sheet 20 is attached to the inner side. In case this arrangment is adopted, contact between the lower end portion of the outside thin sheet body 14 and the draw-up part 13 at the step 19 becomes intimate, and furthermore surface contact with the drawup part 13 is made, thus ensuring smooth draw-up of kerosene.

In FIGS. 5 through 9, the reason for somewhat projecting the top edge of the combustion part base fabric 12 beyond the tip edge of the thin sheet body or bodies 14 is to improve the spreading of fire at the time of ignition and minimize odor. Requirements considered for improving the fire spreading are: (1) the presence of a moderate amount of kerosene, (2) small heat capacity, and (3) air-filled pores; the thin sheet bodies 14 made of ceramic fiber, however, have too large an oil content to meet the requirements (2) and (3), thus failing to provide very much improved fire spreading. For this reason, the top edge of the combustion part base fabric 12 has been somewhat projected beyond the thin sheet body or bodies 14 thereby to meet all the three requirements described above. Paticularly, "the presence of a moderate amount of kerosene" is met obviously, "small heat capacity" is met by making the combustion part base fabric 12 thinner than in conventional wicks, and "air-filled pores" is met in that said fabric is made mainly of glass fiber and hence has relatively large capillary tubes.

Capability of Exploitation in Industry

As has been described so far, according to the invention, the increased oil content of the combustion part suppresses the formation of tar, and even if tar forms, it can be removed by burning-off cleaning since it forms on the surface, and the combustion rate will not decrease so much even if kerosene of inferior quality is used, and thus, a highly durable wick for liquid fuel burners can be provided.

We claim:

1. A wick for liquid fuel burners comprising an elongated textile fabric base having an upper part on which combustion takes place and a lower part connected to said upper part and through which liquid fuel is drawn to be supplied to said upper part, characterized in that:

both of said parts are knitted integrally on a Raschal Loom and formed in one piece in a cylindrical configuration;

said fabric base of said upper part is thinner than that of said lower part; and a thin flexible sheet-like cylindrical body comprising fine ceramic fibers bound together by a flexible organic binder is fastened by sewing to at least one side of said upper part, said body having a higher fuel content, in operation, than that of said upper part so as to reduce the operating temperature of that portion of said wick on which combustion takes place.

2. A wick in accordance with claim 1 characterized in that:

there are two sheet-like bodies, one fastened to each side of the upper part.

3. A wick in accordance with claim 1 characterized in that:

the upper part projects above the sheet-like body.

4. A wick for liquid fuel burners in accordance with claim 1, characterized in that said ceramic fibers are 2–3$\mu$ thick.

* * * * *